US006966146B2

(12) United States Patent
Pease

(10) Patent No.: US 6,966,146 B2
(45) Date of Patent: Nov. 22, 2005

(54) TWO DIRECTIONAL CROSSING GATE ARM PROTECTION ASSEMBLY

(75) Inventor: Ronald Pease, Hickory Hills, IL (US)

(73) Assignee: Western-Cullen-Hayes, Inc., Hickory Hills, IL (US)

( * ) Notice: Subject to any disclaimer, the term of this patent is extended or adjusted under 35 U.S.C. 154(b) by 0 days.

(21) Appl. No.: 10/325,808

(22) Filed: Dec. 18, 2002

(65) Prior Publication Data

US 2004/0118048 A1 Jun. 24, 2004

(51) Int. Cl.[7] ..... E01F 13/00
(52) U.S. Cl. ..... 49/49
(58) Field of Search ..... 49/49, 9, 34, 141; 105/341; 404/10

(56) References Cited

U.S. PATENT DOCUMENTS 1,382,534 A * 6/1921 Oelenschlager et al. ..... 49/247
1,535,753 A * 4/1925 Weiser ..... 246/128
3,394,498 A * 7/1968 Reinitz et al. ..... 49/141
4,219,969 A * 9/1980 Reinitz et al. ..... 49/141
4,364,200 A * 12/1982 Cobb ..... 49/192
4,469,660 A 9/1984 Jones et al.
4,897,960 A 2/1990 Barvinek et al.
5,904,115 A * 5/1999 Durbin et al. ..... 116/28 R
6,327,818 B1 12/2001 Pease
6,470,626 B2 * 10/2002 Luetzow et al. ..... 49/9
6,672,008 B1 * 1/2004 Luetzow et al. ..... 49/9

OTHER PUBLICATIONS

Copy of document from National Electric Gate Company web page, Gate Saver, 1 page.

* cited by examiner

*Primary Examiner*—Gregory J. Strimbu
(74) *Attorney, Agent, or Firm*—Banner & Witcoff, Ltd.

(57) ABSTRACT

A railroad crossing gate assembly includes a gate arm adapter, which is pivotally mounted to allow a lowered gate arm to rotate in response to a generally perpendicular force in a generally horizontal plane either toward or away from a railroad crossing. The gate arm mechanism further includes multiple interchangeable spring assemblies that generate a return force to bring a displaced gate arm back to its normal operating position, and at least two latch hook assemblies for selectively latching the gate arm in its normal position and controlling the rate of return of the gate arm from a displaced position through application of a pivotally leveraged force to a braking surface of the adapter.

16 Claims, 9 Drawing Sheets

TWO DIRECTIONAL CROSSING GATE ARM PROTECTION ASSEMBLY

FIELD OF THE INVENTION

The invention relates generally to an improved gate device for preventing pedestrians and vehicular traffic from crossing railroad grades. Specifically, the present invention relates to gate devices that protect lowered railroad crossing gate arms from damage.

BACKGROUND OF THE INVENTION

Railroad crossing gate arms are lowered from a vertical position to a horizontal position to block traffic from crossing railroad tracks when a train is present. When lowered to their horizontal position, gate arms can suffer damage from passing vehicles, wind pressure and vandalism. Damage frequently results in broken gate arms that sever at their point of attachment to a crossing gate assembly. Such damage risks exposing pedestrians and vehicular traffic to improperly guarded train crossings. To maintain safety and the integrity of grade crossing equipment, railroads expend substantial resources monitoring, repairing and replacing damaged crossing gates. Thus, in the first instance, it is advantageous to protect lowered gate arms from damage.

Various methods of protecting gate arms from damage were known to the prior art. Employing camblocks and ball bearings, U.S. Pat. No. 4,897,960 issued to Barvinek, et al., (hereinafter referred to as "Barvinek") describes a mechanism designed to provide flexibility to lowered gate arms. Barvinek discloses a housing for pivotally mounting a support tube that swings a partially translucent, internally illuminated, impact-resistant gate arm away from an applied force. A camblock is mounted inside the housing, allowing the gate arm support tube, having a pair of ball bearings retained within, to rotate around a retaining pin that extends upwardly through the center of the camblock when force from a passing vehicle is applied. Downward force on the rotating gate arm support tube, applied by a coil spring mounted on the retaining pin, forces the arm to return to its original position parallel with the groove of the camblock when the force dissipates. However, Barvinek suffers from numerous problems. Relying on cam blocks and ball bearings, Barvinek is expensive to manufacture, monitor and maintain. Moreover, Barvinek cannot return a displaced gate arm to a position parallel with the groove of the camblock if the gate mechanism rises while the gate is displaced. Finally, Barvinek provides no control over the rate of gate arm return and cannot prevent gate arm over travel into the flow of traffic.

Alternatively, U.S. Pat. No. 5,469,660, issued to Tamenne, (hereinafter referred to as "Tamenne") employs a spring and hydraulic piston system. Tamenne discloses a pivot assembly allowing a lowered gate arm to rotate away from traffic when a passing vehicle applies pressure and then to return to its original position once pressure is removed. The pivot assembly is mounted on a counter-weighted gate arm mechanism and includes springs mounted on a shuttle post assembly to return the gate arm to a position perpendicular to the flow of traffic. The pivot assembly includes a hydraulic piston to buffer the rate of gate arm return and a weight channel to counterbalance the gate mechanism's main counterweight when the gate arm is rotated away from passing traffic. However, Tamenne also suffers from numerous problems. Tamenne's hydraulic piston system, like Barvinek's camblock and ball bearing system, is expensive to manufacture, monitor and maintain. Further, Tamenne's weight channel counterbalance places an imbalanced strain on the gate arm pivot assembly, risking damage to the gate arm mechanism. Tamenne also decreases safety at crossing grades when the gate arm is displaced, because the weight channel swings from a position generally parallel with the flow of traffic to a position generally perpendicular to the flow of traffic and through an area where pedestrians may be standing. Like Bamivek, Tamenne is incapable of returning a displaced gate arm back to its normal position if the gate mechanism rises while the gate is displaced.

Finally, U.S. Pat. No. 6,327,818 B1, issued to Pease (hereinafter referred to as "Pease I"), provides a crossing gate assembly that can rotate a crossing gate arm in a single direction, toward the railroad track crossing, out of the way of a damaging force, such as that of a vehicle approaching the railroad crossing, while returning the gate to its normal position. The Pease I assembly is capable of being adjusted for installation in conditions requiring varied gate arm lengths and flexibilities, is capable of preventing excessive impact when the gate arm returns to its normal position, prevents gate arm over travel upon return from a displaced position, is capable of being adjusted for varying gate arm return force requirements, is less expensive than existing spring-based crossing guard mechanisms, and is not subject to the potential for deterioration of a cam-and-bearing based crossing gate assemblies. The Pease I assembly is limited, however, to a single direction of rotation.

Therefore, a need exists for a crossing gate assembly that can rotate a crossing gate arm out of the way of a damaging force that can come from either of two directions; in the direction of the railroad tracks or away from the railroad tracks, while safely and efficiently returning the gate to its normal position, that is capable of being adjusted for installation in conditions requiring varied gate arm lengths and flexibilities, that is capable of preventing excessive impact when the gate arm returns to its normal position, that prevents gate arm over travel upon return from a displaced position, that is capable of being adjusted for varying gate arm return force requirements, that is less expensive than existing spring-based crossing guard assemblies, and that is not subject to the potential for deterioration of a cam-and-bearing based crossing gate assemblies.

SUMMARY OF THE INVENTION

The present invention provides a crossing gate assembly for use in a railroad track crossing gate. In one embodiment, the crossing gate assembly includes a gate arm adapter for receiving the gate arm and allowing rotation of the gate arm away from a normal operating position, either toward the railroad track crossing, or away from the railroad track crossing, approximately perpendicular to a flow of traffic upon application of a displacement force, such as that of an automobile impact. The gate arm adapter is capable of being pivotally mounted to a vertical support structure to allow the upward or downward rotation of the gate arm. A pair of return force mechanisms coupled to the gate arm adapter provides for a return of a displaced gate arm adapter to the normal operating position upon removal of the generally horizontal displacement force. In the one embodiment, the crossing gate assembly further includes a pair of latch hook assemblies that hold the gate arm adapter in its normal operating position in the absence of a displacement force. In another embodiment, the crossing gate assembly further includes a pair of drag brakes that retard a rate of return of the gate arm adapter to the normal operating position from a displaced position upon removal of the displacement force.

In another embodiment, the crossing gate assembly includes a crossing gate arm, the gate arm adapter, and a pair of return force mechanism attachment points. The gate arm adapter receives the crossing gate arm and includes a hinge pin that allows rotation of the gate arm away from the normal operating position upon application of the displacement force. The return force mechanism attachment points are opposite the hinge pin from the gate arm, and the return force mechanism attachment points, the hinge pin, and the gate arm are disposed in a generally fixed spatial relationship.

In another embodiment, the crossing gate assembly includes a pair of latch hook assemblies. Each latch hook assembly includes a pivotally levered latch that selectively restrains the gate arm adapter in its normal operating position, and a latch hook pressure mechanism that applies a leveraging force to the pivotally mounted latch to produce a pivotally levered force of the latch. Each latch hook assembly further includes a hook and drag surface that receives the pivotally levered force of the latch upon application of a displacement force to the crossing gate assembly.

DETAILED DESCRIPTION OF THE PREFERRED EMBODIMENT

The present invention can be more fully understood with reference to FIGS. 1–7A. FIGS. 1A, 1B, and 1C are perspective views of a crossing gate assembly, generally, 100 in operation. Normally, the crossing gate assembly 100 is in a substantially upright position (not shown), holding a crossing gate arm 202 in a generally vertical orientation allowing vehicles 1 to proceed through a railroad crossing in the absence of train traffic. When actuated by an oncoming train, the crossing gate assembly 100 lowers the crossing gate arm 202, bringing the crossing gate arm 202 into a position approximately parallel to the ground, thus blocking vehicular traffic 1 from proceeding through the railroad crossing as shown in FIG. 1A.

Figure 1A:
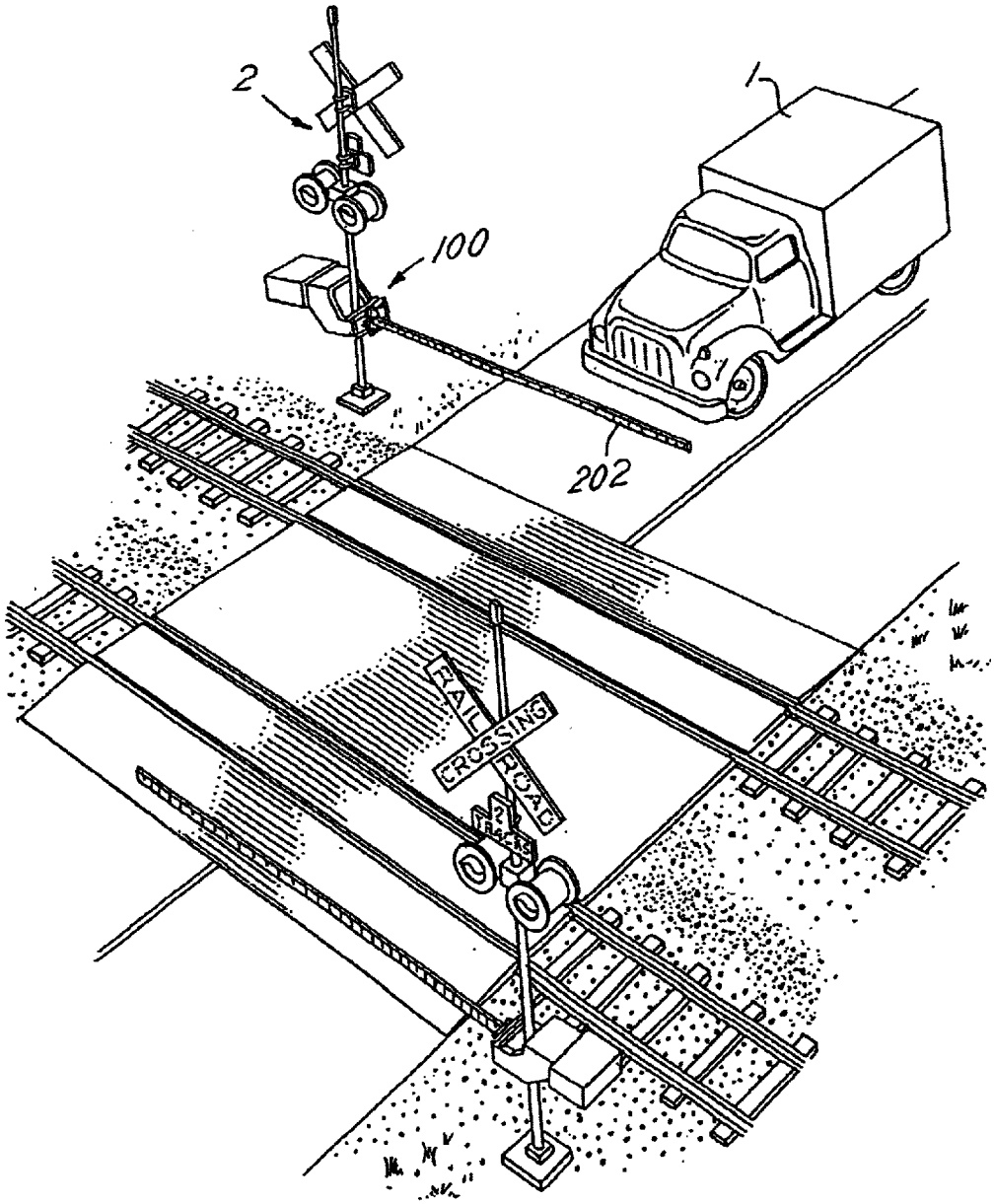
FIGS. 1A, 1B, and 1C are perspective views of a crossing gate assembly in accordance with a preferred embodiment of the present invention.
Figure 1B:
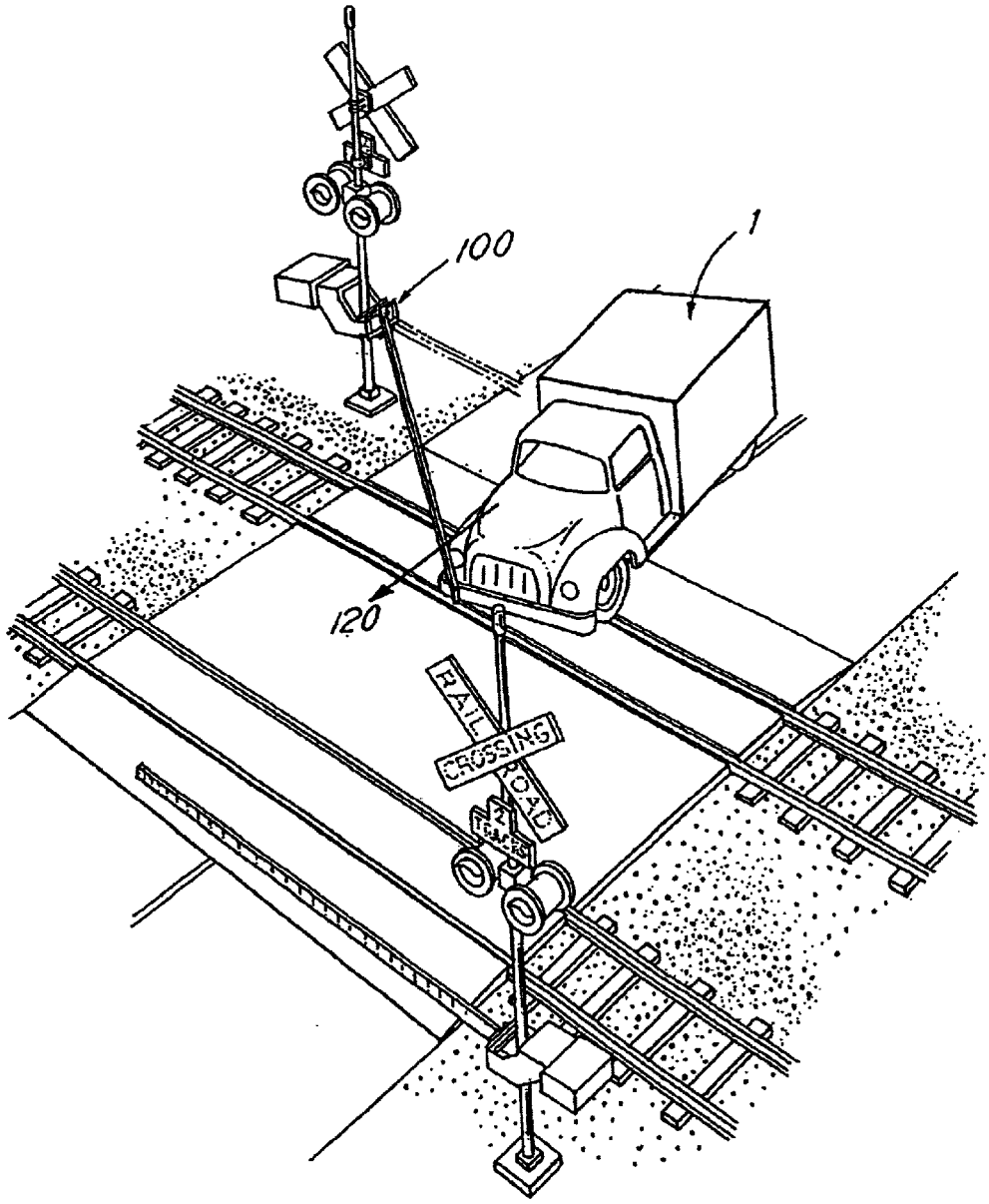

In the event that a displacement force 120, e.g., that of an automobile 1 impact, is applied to the crossing gate arm 202 in a direction toward the railroad track crossing, as shown in FIG. 1B, the crossing gate assembly 100 releases the crossing gate arm 202 so that no permanent damage occurs. Once the displacement force 120 is removed, the crossing gate assembly 100 restores the crossing gate arm to a position approximately parallel to the ground, blocking vehicular traffic as shown in FIG. 1A.

Figure 1C:
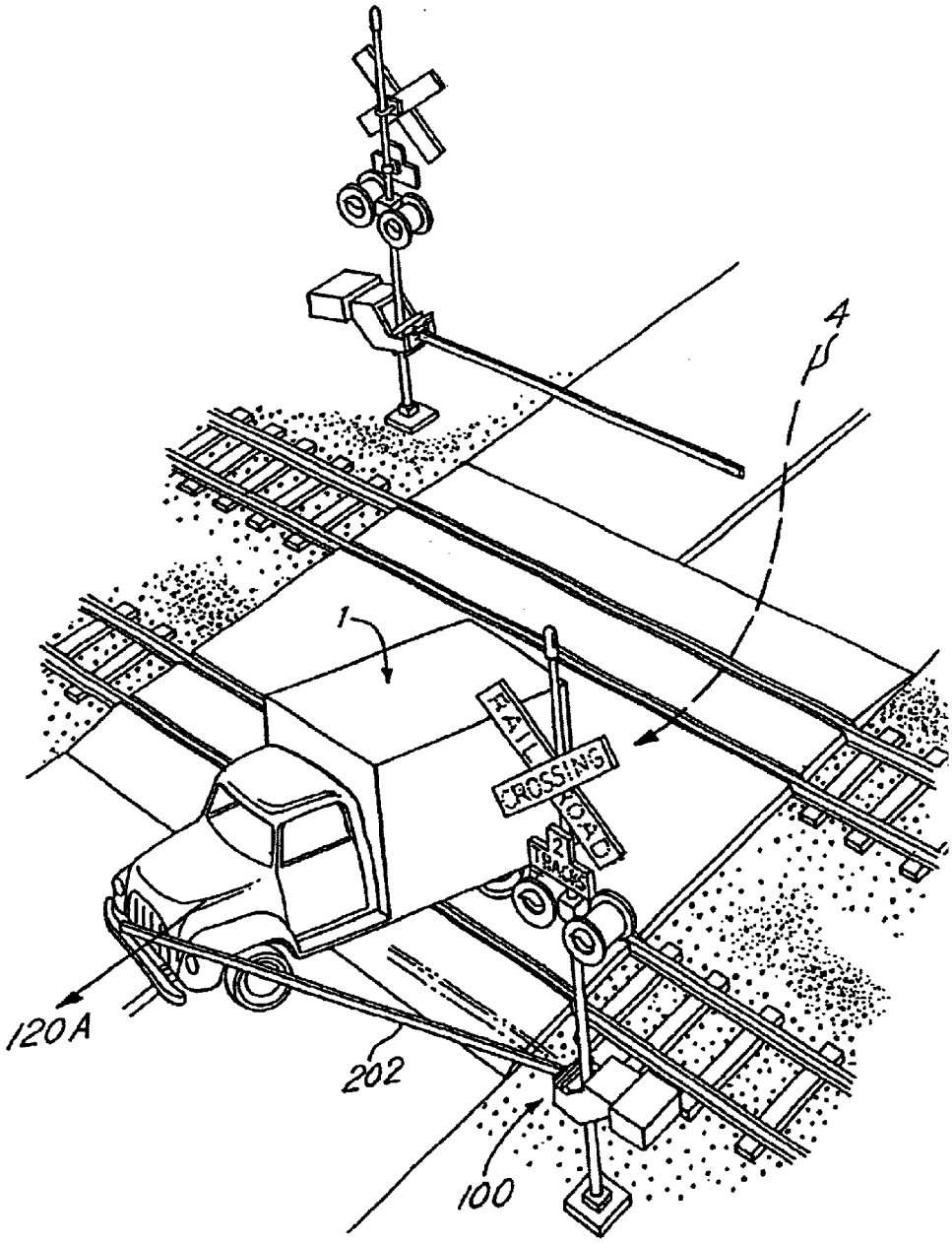

Automobile drivers, in an attempt to circumvent a railroad crossing gate arm 202, may follow a circuitous path 4 around the lowered crossing gate arm, as shown in FIG. 1C. In the event that a displacement force 120A, such as that of an automobile 1 impact, is applied to the crossing gate arm 202 away from the railroad track crossing, the crossing gate assembly releases the crossing gate arm 202 so that no permanent damage occurs. Once the displacement force 120A is removed, the crossing gate assembly 100 restores the crossing gate arm to a position approximately parallel to the ground, blocking vehicular traffic as shown in FIG. 1A.

Figure 2:
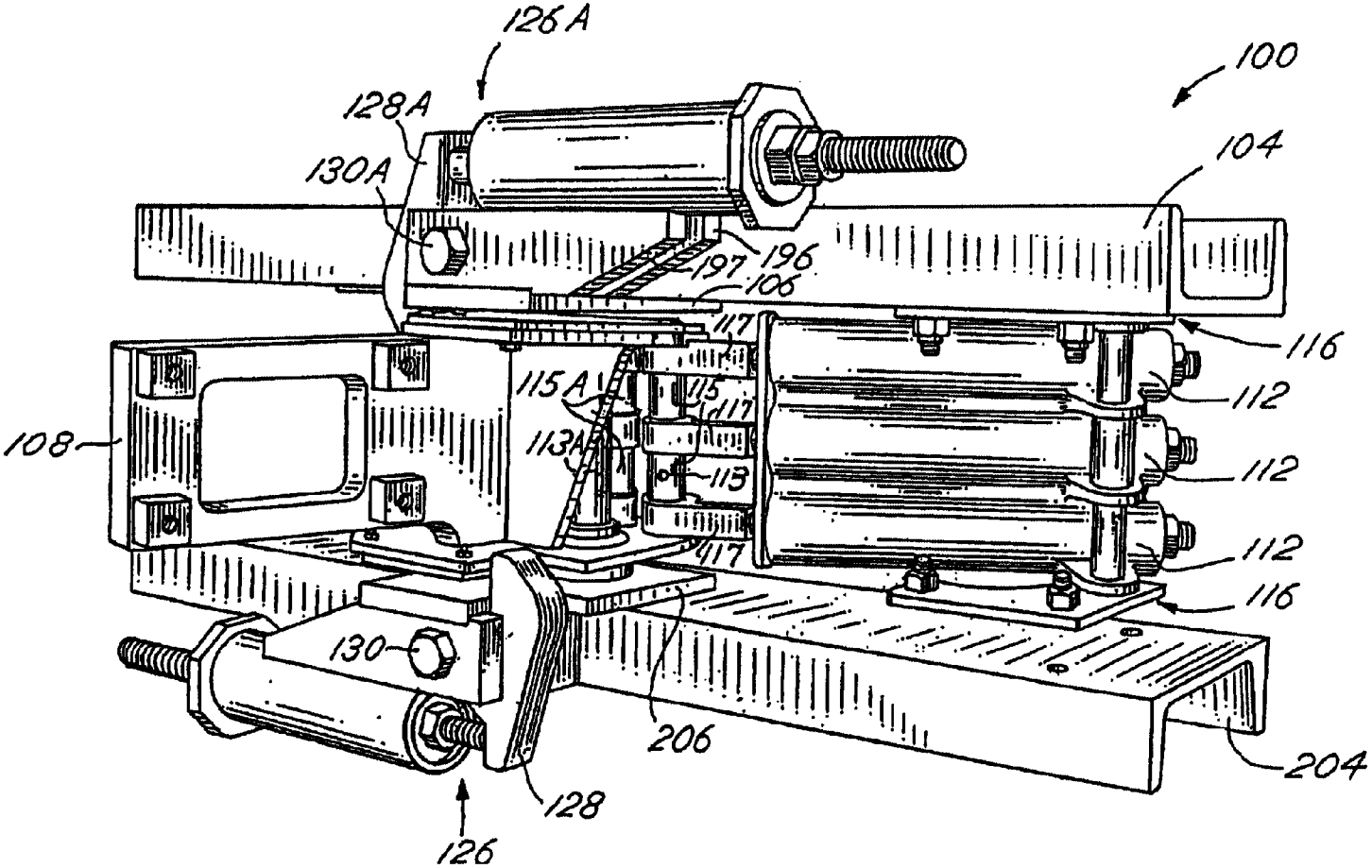
FIG. 2 is a perspective view of a crossing gate assembly in accordance with a preferred embodiment of the present invention.
Figure 3:
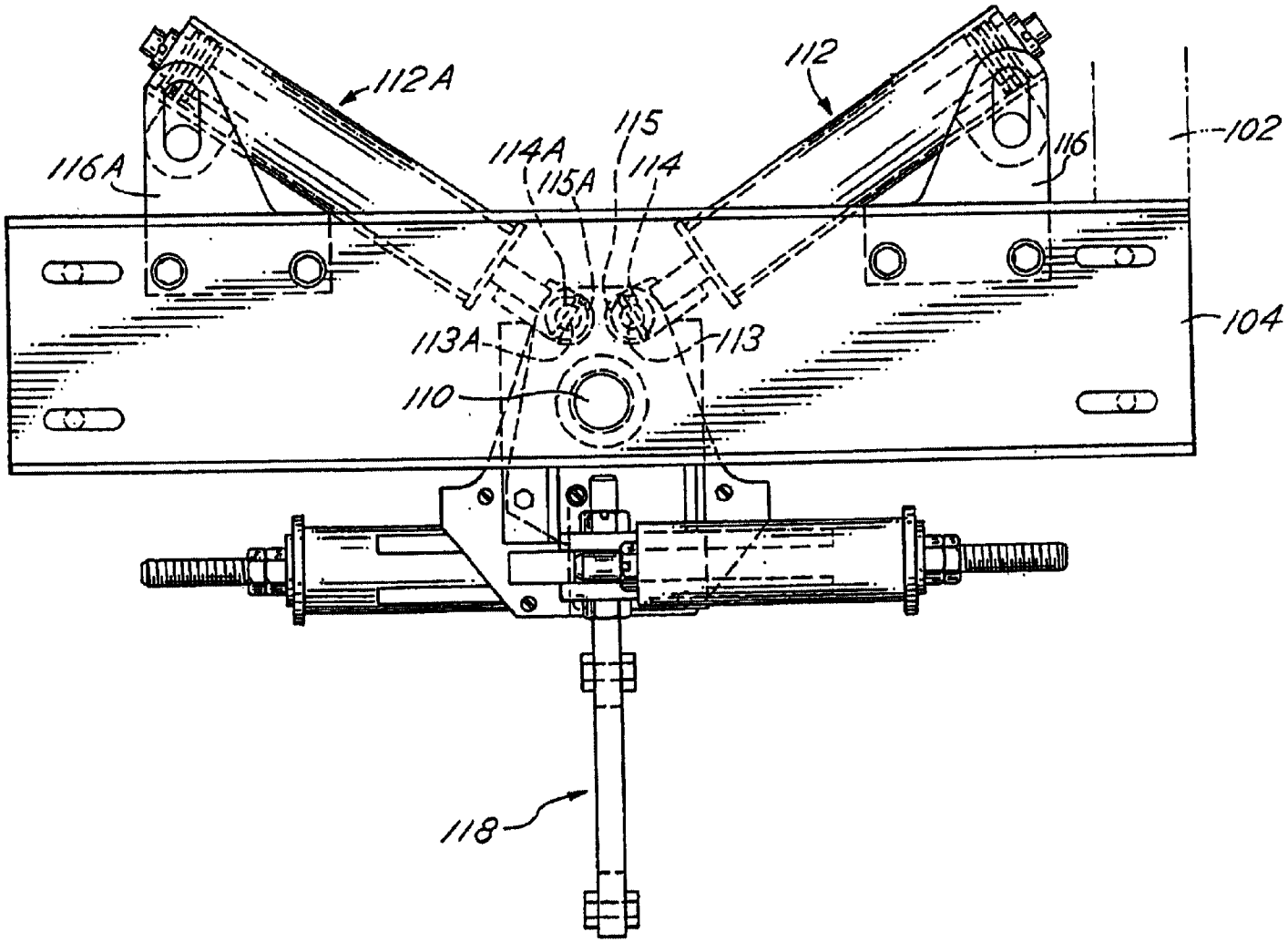
FIG. 3 is a partial plan view of the crossing gate assembly of FIG. 2 in accordance with a preferred embodiment of the present invention with the gate arm adapter in a normal position.
Figure 6:
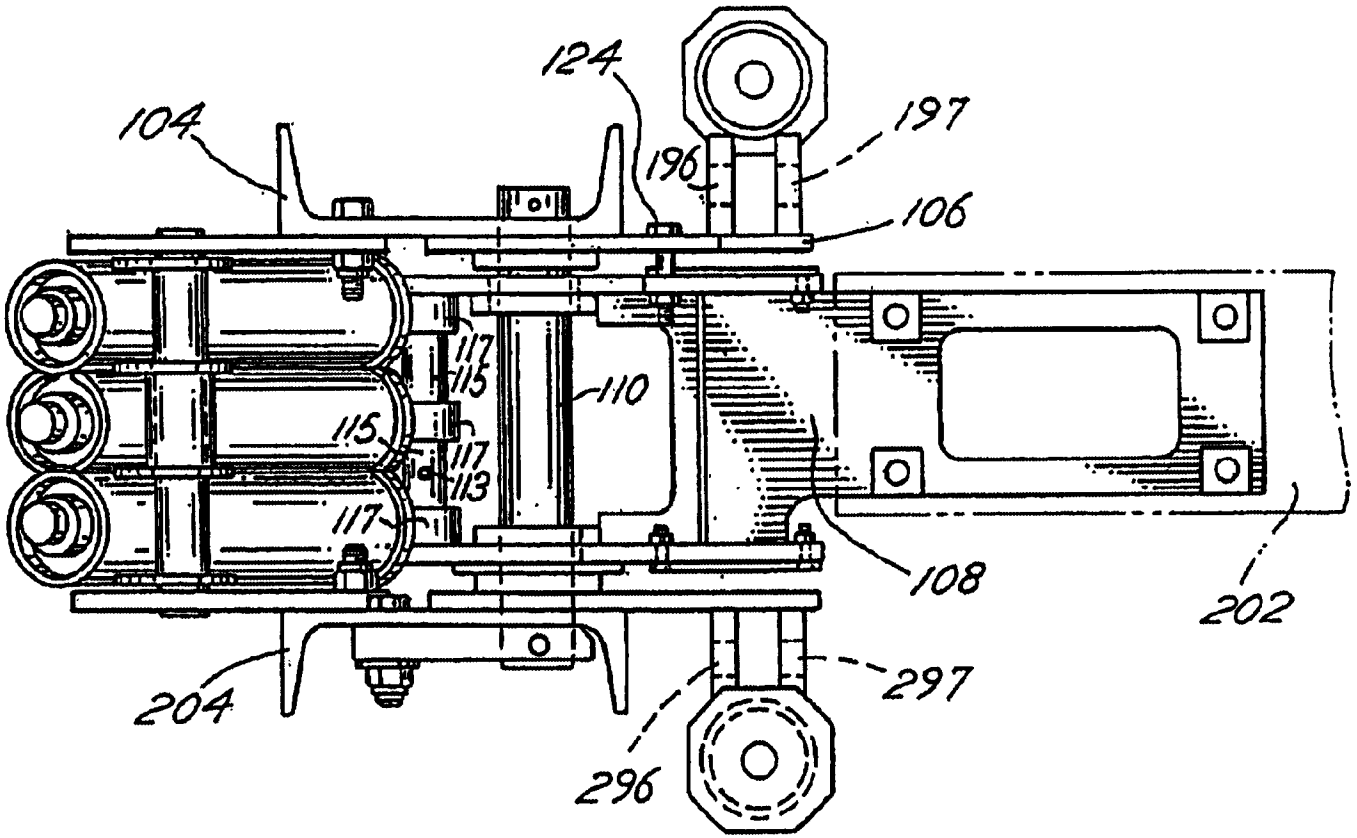
FIG. 6 is a partial side view of the crossing gate assembly of FIGS. 2–5 in accordance with a preferred embodiment of the present invention.

FIG. 2 is a detailed perspective view, and FIGS. 3 and 6 are a detailed partial top view and a partial side view, respectively, of the crossing gate assembly 100 constructed in accordance with a preferred embodiment of the present invention. Crossing gate assembly 100 is pivotally mounted on a vertical support 2 that also typically serves as a mounting support for railroad crossing warning lights and signage. Crossing gate assemblies, such as crossing gate assembly 100, are typically attached to the vertical support by two crossing gate support arms 102 (one shown). The crossing gate support arms 102 are attached to crossing gate assembly 100 at opposite ends of the assembly and raise and lower the crossing gate assembly, thereby raising and lowering a crossing gate arm 202 attached to the crossing gate assembly, in a substantially vertical plane.

As shown in FIGS. 2 and 6, crossing gate assembly 100 includes an upper cross channel 104 and a lower cross channel 204. Each cross channel 104, 204 is attached to each of the crossing gate support arms (e.g., crossing gate support arm 102), thereby pivotally affixing crossing gate assembly 100 to the vertical support 2. As shown in FIGS. 2 and 6, cross channels 104, 204 are fitted with an upper hinge bracket 106 and a lower hinge bracket 206 that are generally centered between crossing gate support arms 102. Crossing gate assembly 100 further includes a gate arm adapter 108 that is pivotally mounted to each cross channel 104, 204 via a hinge pin 110. As shown in FIG. 6, hinge pin 110 is substantially perpendicularly disposed between, and extends through an aperture (not shown) in, each of cross channels 104, 204 and hinge brackets 106, 206.

Crossing gate assembly 100 further includes a pair of return force mechanisms that each includes one or more, preferably three, spring assemblies 112, 112A. Each spring assembly 112, 112A is pivotally attached to the gate arm adapter 108 via a pair of spring assembly hinge pins 114, 114A. Spring assembly hinge pin sleeves 115, 115A fit over spring assembly hinge pin 114 acting as spacers to separate spring assembly adapters 117. Using a fastener 113, 113A through a lower sleeve 115, 115A hole and the spring assembly hinge pin 114, 114A, all parts stay in place within the top and bottom flanges of the gate arm adapter 108. Spring assemblies 112, 112A attach to the cross channels 104, 204 via mounting flanges 116, 116A using a similar pin and sleeve arrangement as just described. Spring assembly adapters 117 each provide an attachment point for the mounting of the spring assemblies 112, 112A, thereby providing for each spring assembly 112, 112A to be pivotally attached to gate arm adapter 108. In a preferred embodiment, gate arm adapter 108 is allowed to rotate about hinge pin 110 while the length of crossing gate arm 202, hinge pin 110 and spring assembly hinge pin 114 and sleeve 115 maintain a generally fixed spatial relationship throughout rotation.

Figure 4:
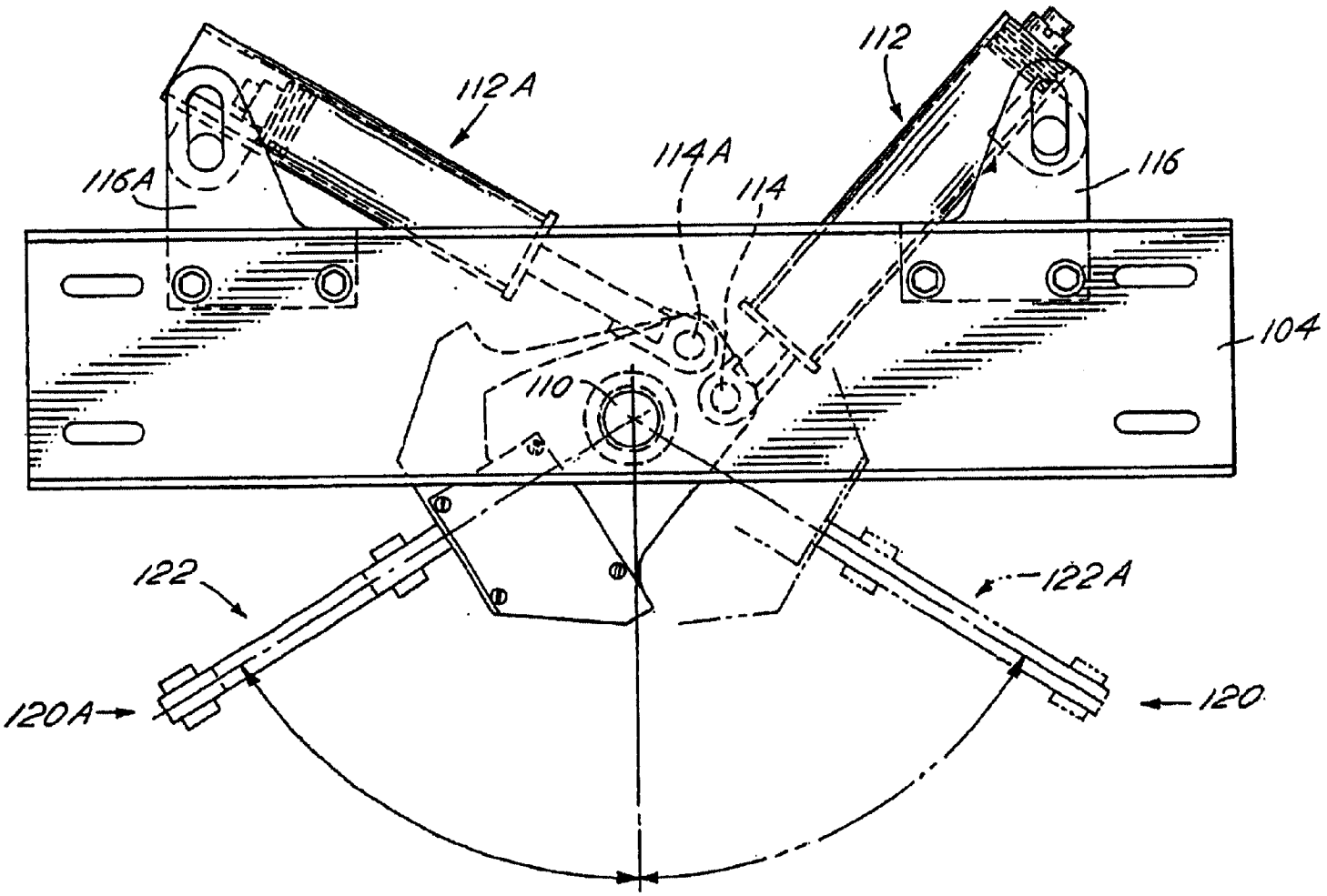
FIG. 4 is a partial plan view of the crossing gate assembly of FIGS. 2 and 3 in accordance with a preferred embodiment of the present invention with the gate arm adapter in a displaced position.

FIG. 4 illustrates the typical operating positions of crossing gate assembly 100 when it is in its lowered and approximately horizontal position relative to the ground. Reference position 118, shown in FIG. 3, indicates a normal operating position of lowered crossing gate assembly 100, wherein gate arm adapter 108 is generally perpendicular or upright to the flow of vehicular traffic. Reference position 122 indicates a displaced position of lowered gate arm adapter 108, achieved when displacement force 120 is applied to gate arm 202 toward the railroad track crossing, causing gate arm adapter 108 to rotate the gate arm 202 in an approximately horizontal plane about hinge pin 110. In the preferred embodiment, the mounting flanges 116, 116A have elongated holes to receive the spring assembly hinge pins. The elongated holes permit the idle, i.e., non-active, assembly spring (assembly spring 112 in FIG. 4 for reference position 122) to adjust within the tolerance of the elongated hole such that the return, i.e., active, spring assembly (assembly spring 112A in FIG. 4 for reference position 122) acts substantially independent of the idle spring assembly. Those skilled in the art will understand that various changes in form and details may be made such that the idle spring assembly may work in tandem with the return spring assembly without departing from the spirit and scope of the present invention. Reference position 122A indicates a displaced position of lowered gate arm adapter 108, achieved when displacement force 120A is applied to gate arm 202 away from the railroad track crossing, causing gate arm adapter 108 to rotate the gate arm 202 in an approximately horizontal plane about hinge pin 110. Note that for reference position 122A, spring assembly 112A is the substantially idle spring assembly, and spring assembly 112 is the return spring assembly. By rotating crossing gate arm 202, crossing gate assembly 100 protects the gate arm 202 from potential damage due to the application of displacement forces 120, 120A. Preferably, the maximum angle of swing during displacement is approximately 68° from the reference position 118; however, one of ordinary skill in the art realizes that other angles than 68° may be employed without departing from the spirit or scope of the present invention.

When displacement force 120 displaces gate arm adapter 108 from normal operating position 118 toward the railroad crossing, each spring assembly 112A provides an approximately horizontal return force on gate arm adapter 108 at spring assembly hinge pin 114A. The return force causes gate arm adapter 108 and gate arm 202 to return from a displaced position 122 back into normal operating position 118 after displacement force 120 is removed. Likewise, when displacement force 120A displaces gate arm adapter 108 from normal operating position 118 away from the railroad crossing, each spring assembly 112 provides an approximately horizontal return force on gate arm adapter 108 at spring assembly hinge pin 114. The return force causes gate arm adapter 108 and gate arm 202 to return from a displaced position 122A back into normal operating position 118 after displacement force 120A is removed. In a preferred embodiment, crossing gate assembly 100 includes an interchangeable selection of spring assemblies 112, 112A to provide more or less return force for returning longer or shorter gate arms 202 from the displaced position 122, 122A to the normal operating position 118. Spring assemblies 112, 112A preferably provide adequate return force on gate arm adapter 108 so that gate arm 202 can be returned from a displaced position 122, 122A to normal position 118 even if crossing gate assembly 100 pivots in the vertical plane about its vertical support, as if to raise gate arm 202 while the gate arm is displaced.

In a preferred embodiment, crossing gate assembly 100 further includes a shear pin 124 that is coupled between upper hinge bracket 106 as shown in FIG. 6, or alternatively lower hinge bracket 206, and gate arm adapter 108. Shearpin 124 provides crossing gate assembly 100 with additional resistance to gate arm 108 rotation in high wind areas, yet will easily shear upon impact with displacement force 120, 120A.

Figure 5:
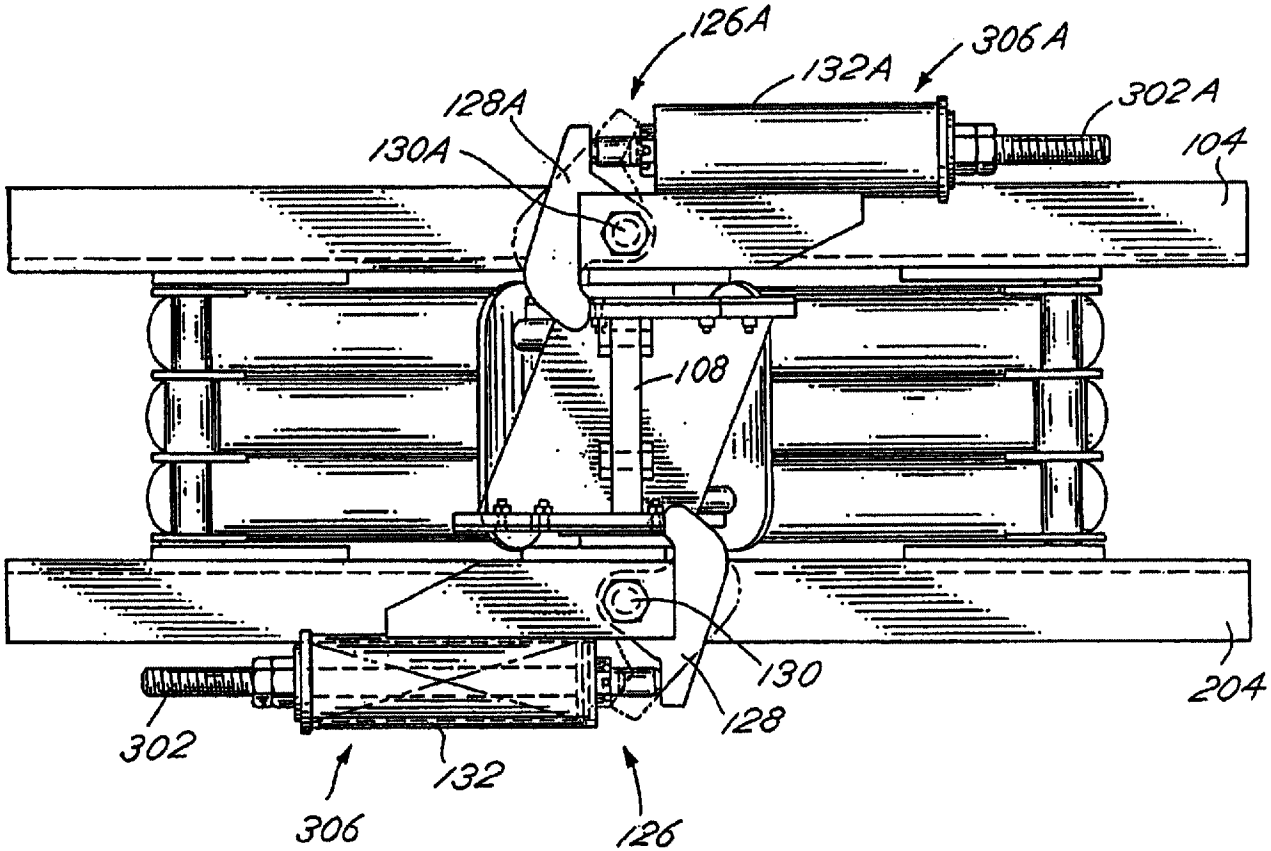
FIG. 5 is a partial front view of the crossing gate assembly of FIGS. 2–4 in accordance with a preferred embodiment of the present invention.
Figures 7, 7A:
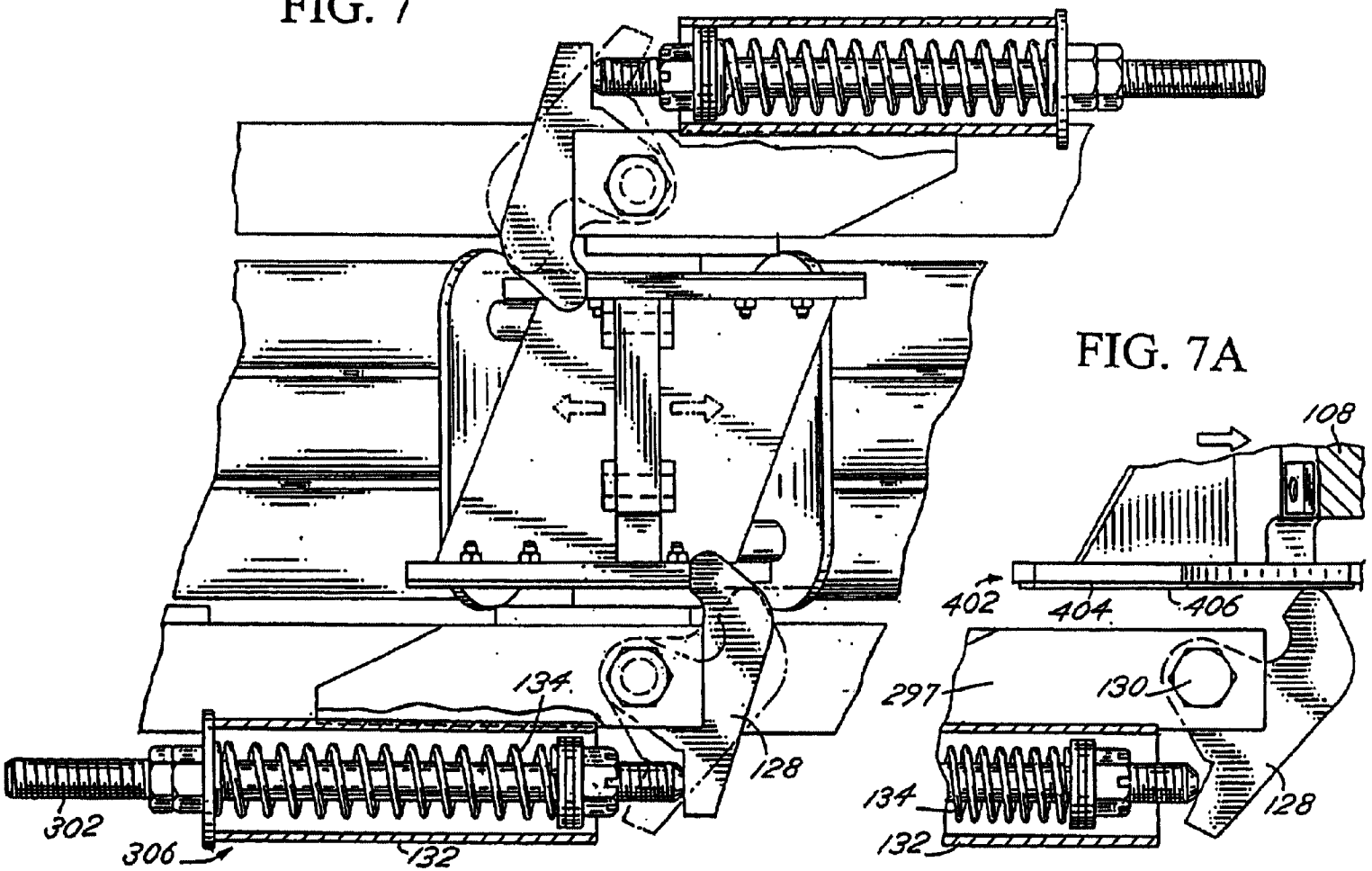
FIG. 7 is an enlarged partial front view of a latch hook assembly of FIGS. 2–6 when operating as a braking mechanism in accordance with a preferred embodiment of the present invention.
FIG. 7A is a detailed view of the latch hook assembly of FIG. 7 when operating as a braking mechanism in accordance with the preferred embodiment of FIGS. 2–6 of the present invention.

Referring now to FIGS. 2, 5 and 7, wherein FIG. 5 is a partial front view of crossing gate assembly 100 in accordance with a preferred embodiment of the present invention, crossing gate assembly 100 further includes a pair of latch hook assemblies 126, 126A. Latch hook assemblies 126, 126A latch gate arm adapter 108 in normal operating position 118 in the absence of displacement forces 120, 120A and serve to retard the rate of return of gate arm adapter 108 from displaced positions 122, 122A. Latch hook assembly 126, e.g., includes a latch hook 128 that is pivotally mounted to latch hook assembly mounting flanges 296, 297, at a latch hinge 130. Latch hook assembly 126 further includes a latch hook pressure mechanism 306 that applies a leveraging force to latch hook 128. Latch hook pressure mechanism 306 includes a latch spring housing 132, and a latch spring 134 retained within a latch spring housing 132 by a latch spring retaining bolt 302. Latch spring housing 132 is attached to lower latch hook assembly mounting flanges 296, 297, which are attached to the lower hinge bracket 206. The opposing latch hook assemblies 126, 126A also act as gate arm adapter stops that serve as a positive return stop for the gate arm adapter 108 when the adapter is displaced by displacement forces 120, 120A, preventing gate arm 108 over travel beyond the normal operating position 118 upon return from displaced position 122, 122A.

Latch hook assemblies 126, 126A, as shown in FIGS. 5, 7, and 7A, latch gate arm adapter 108 in normal operating position 118 in the absence of displacement forces 120, 120A. The compressed latch spring 134 of the lower latch hook assembly 126, for example, transmits a leveraging force to latch hook 128 via latch spring retaining bolt 302. The leveraging force latches gate arm adapter 108 in normal operating position 118. Preferably, latch hook 128 will remain latched to gate arm adapter 108 by the leveraged force of latch spring 134 through a minor rotation, such as 8° to 10°, out of the normal operating position 118 of gate arm 202, allowing crossing gate assembly to absorb a minor horizontal displacement force without unlatching. Those of ordinary skill in the art will realize that other angles than 8° to 10° may be employed without departing from the spirit or scope of the present invention. The upper latch hook assembly 126A operates in the same manner.

FIG. 7A is a partial front view of latch hook assembly 126 when operating as a braking mechanism in accordance with a preferred embodiment of the present invention. Latch hook assembly 126, as shown in FIG. 7A, operates as a drag brake, retarding the rate of return of gate arm adapter 108 to normal operating position 118 when the adapter is in displaced position 122A. When displacement force 120A is applied to gate arm 108 causing gate arm adapter 108 to rotate out of its normal operating position 118, gate arm adapter 108 applies a horizontal force in the directions of displacement force 120A on an end of latch hook 128 opposite the end disposed next to latch spring retaining bolt 302. The force causes latch hook 128 to pivot about latch hinge 130, depressing latch spring retaining bolt 302 and compressing latch spring 134 until latch hook 128 releases gate arm 108. A brake plate 402, fitted with a replaceable wear plate 404 that presents a hook and drag surface 406 to latch hook 128, is mounted on gate arm adapter 108 to receive the pivotally levered force of latch hook 128 when gate arm adapter 108 is displaced from normal operating position 118.

Pressure transmitted by latch spring 134 through latch hook 128 to gate arm adapter 108 via wear plate 404 causes a frictional contact between latch hook 128 and hook and drag surface 406 as the gate arm adapter 108 returns from displaced position 122A to normal operating position 118 and latch hook 128 correspondingly translates across hook and drag surface 406. The frictional contact retards the return of gate arm adapter 108. By retarding the rate of return of gate arm adapter 108 from displaced position 122A under power from spring assembly 112, latch hook assembly 126 operates as a drag brake and prevents excessive impact between gate arm adapter 108 and latch hook 128A of the upper latch hook assembly 126A, thus dampening any rebound effect from engaging the opposing spring assembly 112A. One of ordinary skill in the art realizes that a variety of latch springs 134 are available to provide more or less retarding force on gate arm adapter 108 and brake plate 402 through levered latch hook 128. Upon return of gate arm assembly 108 to normal operating position 118, latch hook assembly 126 returns to the position shown in FIGS. 5 and 7.

In sum, the present invention provides a crossing gate assembly 100 that can rotate a crossing gate arm 202 out of the way of a damaging force, either toward or away from the railroad crossing, while safely and efficiently returning the gate arm to its normal operating position 118. Crossing gate assembly 100 includes latch hook assemblies 126, 126A that latch the gate arm in normal operating position 118. Crossing gate assembly 100 further includes return force mechanisms that include multiple spring assemblies 112, 112A that returns the gate arm 202 to the normal operating position after the gate arm has been displaced by a displacing force 120, 120A. By varying the number of spring assemblies 112, 112A used in the return force mechanism, or by using spring assemblies that apply a greater or lesser return force, crossing gate assembly 100 is capable of being adjusted for installation in conditions requiring varied gate arm lengths and flexibilities and is capable of being adjusted for varying gate arm return force requirements. Latch hook assemblies 126, 126A also operate as drag brakes that are capable of preventing excessive impact and rebound when gate arm 202 returns to its normal operating position from a displaced position 122, 122A.

Opposing latch hooks 128, 128A prevent gate arm over travel upon return from a displaced position 122, 122A. By employing a drag brake, as opposed to a hydraulic piston of the prior art, to retard the rate of return of the gate arm 202 from a displaced position 122, 122A, the present invention is less expensive than existing spring-based crossing guard assemblies. Furthermore, by employing a return force mechanism that includes one or more spring assemblies applying an approximately horizontal return force when crossing gate assembly 100 is in an approximately horizontal position, the potential for deterioration of a cam-and-bearing based crossing guard assembly is eliminated.

While the present invention has been particularly shown and described with reference to particular embodiments thereof, it will be understood by those skilled in the art that various changes in form and details may be made therein without departing from the spirit and scope of the present invention.

What is claimed is:

1. A crossing gate assembly that is activated when detecting a train, said gate assembly having a support structure and a crossing gate arm pivotally mounted on said support structure about a first axis spaced from and substantially aligned with both a forward and a reverse direction of a flow path of traffic past said crossing gate assembly, and said gate arm being pivotal about said first axis between a raised, open position for allowing the traffic to pass said gate assembly and a lowered position for blocking said both directions of the flow path of traffic past said gate assembly; said gate assembly includes a gate arm mechanism comprising:

a crossing gate arm adapter for supporting said gate arm, said gate arm adapter and said gate arm being pivotal about said first axis, said gate arm adapter with said gate arm thereon being pivotally mounted on said support structures, which permits the gate arm adapter to rotate about a second axis transverse to said first axis, said gate arm adapter and said gate arm both being pivotal about said second axis between said lowered, blocking position and a displaced position in response to a displacement force imparted against said gate arm in a direction substantially aligned with both of said directions of said flow path of traffic, rotating the gate arm one of toward and away from a railroad crossing, at least two separate, positive, independent return force mechanisms coupled to said gate arm adapter for returning said gate arm adapter with said gate arm to said lowered, blocking position of said gate arm upon removal of said displacement force, and first and second latch hook assemblies each comprising a biasing element having a generally horizontally extending longitudinal axis which biases a latch pivotally mounted about an axis generally perpendicular to said longitudinal axis into engagement with said gate arm adapter to hold the gate arm in said lowered, blocking position in an absence of said displacement force.

2. The crossing gate assembly of claim 1, wherein each latch comprises a latch hook.

3. The crossing gate assembly of claim 1, wherein the latches prevent gate arm over travel upon return of the gate arm from the displaced position.

4. The crossing gate assembly of claim 1, wherein at least one of said latches retards a rate of return of the gate arm from the displaced position upon removal of the displacement force.

5. The crossing gate assembly of claim 4, wherein the biasing elements apply a leveraging force to the latches which causes at least one of the latches to supply a levered force to the gate arm adapter which retards the gate arm from returning to said lowered, blocking position from the displaced position upon removal of the displacement force.

6. The crossing gate assembly of claim 5, wherein each biasing element comprises a latch spring.

7. The crossing gate assembly of claim 5, further comprising wear plates affixed to the gate arm adapter for receiving the levered forces of the latches.

8. The crossing gate assembly of claim 1, wherein each said return force mechanism comprises a spring assembly that is pivotally mounted to the gate arm adapter.

9. The crossing gate assembly of claim 1, wherein each said latch selectively restrains said gate arm in said lowered blocking position; said biasing elements apply leveraging forces to said latches to produce pivotally levered forces; and hook and drag surfaces that receive the pivotally levered forces of the latches upon application of the displacement force to the gate arm.

10. The crossing gate assembly of claim 9, whereby said latches prevent gate arm over travel upon return of the gate arm from the displaced position.

11. The crossing gate assembly of claim 1 wherein said gate arm adapter and said gate arm are pivotal about said second axis in the raised position, in the lowered position and in positions therebetween.

12. A crossing gate assembly comprising:

a gate arm adapter for receiving a gate arm, wherein the gate arm adapter is capable of being pivotally mounted to a vertical support structure to allow rotation of the gate arm adapter away from a normal operating position in which the gate arm is approximately perpendicular to both a forward and a reverse direction of a flow of traffic past said crossing gate assembly upon application of a displacement force generally parallel to said forward and reverse directions;

at least two separate, positive, independent return force mechanisms coupled to the gate arm adapter that provide for a return of the gate arm adapter from a displaced position to said normal operating position upon removal of the displacement force; and at least two drag brakes that retard a rate of return of the gate arm adapter to the normal operating position from said displaced position upon removal of the displacement force, each of said drag brakes including:

a latch hook pivotally mounted about an axis;

a latch hook pressure mechanism that is disposed in contact with the latch hook and that applies a leveraging force to the latch hook said latch hook pressure mechanism having a generally horizontally extending longitudinal axis which is generally perpendicular to said latch hook pivot axis; and wherein the leveraging force causes the latch hook to apply a levered force to the gate arm adapter that retards the rate of return of the gate arm adapter to the normal operating position from the displaced position upon removal of the displacement force.

13. The crossing gate assembly of claim 12, wherein each latch hook pressure mechanism comprises:

a compressed spring assembly that applies said leveraging force to the latch hook; and a compressed spring assembly housing that houses the compressed spring assembly.

14. The crossing gate assembly of claim 12, further comprising at least two wear plates affixed to the gate arm adapter.

15. A crossing gate assembly that is activated when detecting a train, said gate assembly having a support structure and a crossing gate arm pivotally mounted on said support structure about a first axis spaced from and substantially aligned with both a forward and a reverse direction of flow path of traffic past said crossing gate assembly, and wherein said gate arm is pivotal about said first axis between a raised, open position for allowing the traffic to pass said gate assembly and a lowered position for blocking said both directions of the flow path of traffic past said gate assembly; said gate assembly includes a gate arm mechanism comprising:

a crossing gate arm adapter for supporting said gate arm for movement about said first axis;

a substantially upright hinge pin mounted on said adapter pivotally supporting said arm about a second axis defined by said upright hinge pin; said gate arm being pivotal about said hinge pin and about said second axis for movement of said gate arm from said lowered blocking position to a displacement position upon application of a displaced force;

at least two separate, positive, independent return force mechanisms mounted on said adapter, each being rotatable about an attachment point and being spaced from said hinge pin, said attachment points, said hinge pin and said gate arm being disposed in a generally fixed spatial relationship; and first and second latch hook assemblies each comprising a biasing element having a generally horizontally extending longitudinal axis which biases a latch pivotally mounted about an axis generally perpendicular to said longitudinal axis into engagement with said gate arm adapter to hold the gate arm in said lowered position in an absence of said displacement force.

16. The crossing gate assembly of claim 15 wherein each said return force mechanism includes a spring assembly.

* * * * *